US006796375B2

(12) United States Patent
Williges

(10) Patent No.: US 6,796,375 B2
(45) Date of Patent: Sep. 28, 2004

(54) COOLING CIRCUIT

(75) Inventor: Martin Williges, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 149 days.

(21) Appl. No.: 09/980,139

(22) PCT Filed: Feb. 21, 2001

(86) PCT No.: PCT/DE01/00637

§ 371 (c)(1),
(2), (4) Date: May 2, 2002

(87) PCT Pub. No.: WO01/75281

PCT Pub. Date: Oct. 11, 2001

(65) Prior Publication Data

US 2002/0189557 A1 Dec. 19, 2002

(30) Foreign Application Priority Data

Apr. 1, 2000 (DE) ..... 100 16 405

(51) Int. Cl.[7] ..... F01P 3/20; F01P 7/04; F01P 7/14; F01P 7/16; F01P 11/16

(52) U.S. Cl. ..... 165/297; 165/288; 165/51; 165/293; 236/34.5; 236/34; 236/78 B; 123/41.09; 123/41.1

(58) Field of Search ..... 165/297, 288, 165/51, 293; 236/34.5, 35, 78 B, 34; 123/41.09, 41.1

(56) References Cited

U.S. PATENT DOCUMENTS

| | | | | | |
|---|---|---|---|---|---|
| 4,804,139 | A | * | 2/1989 | Bier | 236/35 |
| 5,529,025 | A | * | 6/1996 | Ranzinger | 123/41.1 |
| 5,555,854 | A | * | 9/1996 | Huemer et al. | 123/41.1 |
| 2002/0121618 | A1 | * | 9/2002 | Williges | 251/129.04 |

FOREIGN PATENT DOCUMENTS

| | | |
|---|---|---|
| DE | 41 09 498 A1 | 9/1992 |
| DE | 199 33 794 A | 2/2000 |
| EP | 0 557 113 A | 8/1993 |

* cited by examiner

*Primary Examiner*—John K. Ford
(74) *Attorney, Agent, or Firm*—Michael J. Striker

(57) ABSTRACT

A coolant circuit (10) includes at least one heat source (12), a radiator (14), and a bypass line (22), which connects a radiator inlet (18) to a radiator return (20) and whose junction (24) has a control valve (26) disposed on it, whose throttle body (58) can be electrically triggered as a function of operating parameters and environmental parameters by means of at least one control unit (40, 42) and divides the coolant flow between the radiator inlet (18) and the bypass line (22). According to a characteristic curve of the control valve (26), the control unit (40, 42) determines a set-point value (50) for the position of the throttle body (58), which sets a ratio of the radiator volume flow to the total coolant flow at the control valve (26).

9 Claims, 3 Drawing Sheets

COOLING CIRCUIT

BACKGROUND OF THE INVENTION

The invention is based on a coolant circuit for cooling an internal combustion engine of a vehicle.

As a rule, a coolant circuit includes a heat source to be cooled, e.g. an internal combustion engine of a vehicle, which is cooled by a coolant by means of free convection or in a concerted manner by means of a coolant pump. The temperature difference over the heat source is merely a function of the magnitude of the volume flow of the cooling medium, whereas the absolute temperature of the cooling medium is determined by the thermal output of the heat source, the heat dissipation via a radiator, and the thermal capacities of the materials.

The heat contained in the heat source can be released again at another location by the radiator or remains in the coolant when the radiator is bypassed via a bypass line. Through a smoothly variable distribution of the coolant flow between a radiator inlet and the bypass line, it is possible to regulate the temperature level of the coolant.

In modern motor vehicles, this regulation is performed by a so-called thermostat valve. In this valve, which is situated at the inlet of the coolant into the engine or at the outlet from the engine, a wax-filled sleeve serves as an actuator. When the wax begins to melt at a particular temperature, its volume increases. The expansion that occurs with an increase in temperature and the contraction during cooling is used to move a throttle body, e.g. a stopper, in the valve so that the radiator inlet opens and the temperature level is kept fairly constant. This therefore constitutes a closed control circuit.

A coolant circuit in which a coolant circulates is characterized by long time constants and lag times. If the temperatures of such a coolant circuit are regulated using simple regulators, e.g. thermostat valves, the regulation is relatively sluggish and not particularly precise. If the thermostat valve is situated on the outlet side of the engine, when the radiator opens, the cold coolant of the radiator first flows through the hot engine until it reaches the thermostat valve at the outlet of the engine and this valve re-closes the radiator somewhat. Thus the temperature oscillates a few times around a set-point value until a steady state is achieved. Even if the thermal output of the heat source spontaneously increases sharply, the temperature of the coolant increases by quite a few degrees first before the thermostat valve has adapted to the new conditions.

DE 41 09 498 A1 has disclosed a device and a method for a very sensitive regulation of the temperature of an internal combustion engine. To this end, a control unit is supplied with a number of input signals, e.g. the engine temperature, the speed and load of the engine, the vehicle speed, the operating state of an air conditioning system or heating system of the vehicle, and the temperature of the cooling water. By taking input signals into account, a set-point value generator of the control unit determines a set-point temperature for the engine. In accordance with a comparison of the actual values to the set-point values, the control unit acts on a three-way valve which is disposed in the vicinity of where a bypass line feeds into a conduit between the engine and a radiator. Depending on the position of the three-way valve, the inlet flow is divided between the radiator inlet and the bypass line. This results in a cooling of the engine not only as a function of operating parameters that are of direct significance to the temperature development, but also as a function of parameters of auxiliary units which influence the temperature only indirectly. In addition, the possibilities for adjusting the optimal temperature are significantly broadened because malfunctions can also be detected and taken into account. Associating different operating conditions with different ranges of temperature set-point values makes it possible to rapidly set the desired temperature, which can be further improved by giving different priorities to the operating conditions.

SUMMARY OF THE INVENTION

In accordance with a characteristic curve of the control valve, the control unit according to the invention determines a set-point value for the adjustment of the throttle body, which adjusts a ratio of the radiator volume flow to the total coolant flow at the control valve. This is equal to the ratio between the difference of a temperature at the outlet of the bypass line minus a set-point temperature at the inlet of the heat source and the difference of the temperature at the outlet of the bypass line minus a temperature at the outlet of the radiator, where the ratio of the radiator volume flow to the total coolant flow is set equal to zero when there is a negative value and is limited to one when there is a value greater than one.

The temperatures required for determining the set-point value are detected by means of temperature sensors. Temperature sensors that are already present can be used for this, provided that they are not situated too far from the locations that are relevant to the determination of the set-point value. Thus, for example, instead of the temperature at the outlet of the bypass line, the temperature downstream of the heat source and/or downstream of the junction of the bypass line can be used for the control if the bypass line is not too long and the distance of the junction from the outlet of the temperature source is not too great.

The coolant circuit according to the invention makes it possible to precisely and quickly set the temperature of the coolant flowing into the heat source to a constant temperature or to a variable temperature that can be externally predetermined. The two coolant paths, on the one hand via the radiator and on the other hand via the bypass line, can be considered as sources of cold and hot coolant. In order to determine the temperature of the cold coolant, a temperature sensor is affixed to the outlet of the radiator in addition to the previously conventional temperature sensor at the outlet of the heat source, e.g. of an engine, for which the coolant circuit according to the invention is particularly suited.

If a third temperature sensor is optionally inserted at the inlet of the heat source, the temperature regulation can be further improved in that the control according to the invention is subordinate to a regulation as a function of the temperature at the inlet of the heat source. Since the control valve can already control the temperature at the inlet of the heat source fairly well with the aid of the temperature control according to the invention, the correcting variable of the regulator, which can be integrated into one of the existing control units, can be limited to a part of the adjustment path of the throttle body of the control valve. A simple, but very functional regulator is suitably used for the regulation, for example a gain-scheduling P regulator. The amplification of the regulator should be made to depend on the coolant volume flow since the sensitivity of the coolant circuit increases with increasing volume flow. The regulator for the primary regulation as a function of the temperature at the inlet of the coolant into the heat source can simultaneously be used to monitor the proper functioning of the control valve. But the monitoring is limited, even with the temperature sensor at the outlet of the coolant from the heat source.

If the coolant circuit is supplied with a number of heat sinks and/or heat sources and if the heat dissipation or heat emission from them changes only slowly over time, the heat sinks and/or heat sources can be simply installed in parallel to the existing ones without significantly altering the regulation performance.

A so-called tap valve embodied as a three-way valve is suitably used as the control valve, whose throttle body is embodied as a valve tap, has at least one distributor conduit passing through it, and can be moved around the rotation axis by means of a drive mechanism.

In contrast to magnetically actuated valves, the control valve according to the invention functions noiselessly. In addition, over the adjusting angle of the throttle body, it has a virtually linear characteristic curve of the volume flow and the volume flow ratio so that the position for an optimal coolant volume flow and the coolant temperature can be controlled. By using a characteristic field, lower-quality valves can also be used. The speed increase primarily results from the knowledge of the coolant outlet temperature so that actions can be taken in an anticipatory fashion instead of using a regulator to react to events that have already occurred. As a result, the temperature regulation, which frequently involves long lag times and is generally sluggish, can be significantly accelerated.

A three-way valve, whose throttle body has a spherical surface and an internal distributor conduit, is particularly suitable for this. This conduit extends lateral to the rotation axis and is open at one circumference surface essentially parallel to the rotation axis, while the opposite circumference surface is closed. Through rotation of the ball, either the circuit via the radiator or the circuit via the bypass line is opened to a greater or lesser degree. The ball valve thus produced, which is struck by the flow in a direction lateral to the rotation axis, has a more ideal mixture characteristic curve than the ball valves that are struck by the flow from underneath. This can be attributed to favorable deflection effects due to the inclined position of the collision surface on the throttle body in the ranges between 60° and 120° of ball rotation. Due to the favorable characteristic curves and flow conditions, the three-way valve is suited for coolant circuits with electrically operated pumps. These can be smaller in size so that their power consumption decreases and the overall efficiency is improved.

In the vicinity of the rotation axis, the valve body of the three-way valve has a temperature sensor which protrudes into a distributor conduit of the throttle body. In this case, it detects a temperature of the coolant, which is simultaneously representative of the temperature at the outlet of the bypass line and at the outlet of the heat source, provided that the bypass line is not too long and the distance of the junction of the bypass line from the heat source is not to great.

A first control unit suitably generates the set-point value for the position of the throttle body and a second electronic control unit, which is integrated into the control valve, processes this set-point value, along with a detected actual value of the position of the throttle body to produce a correcting variable for the position of the throttle body. The control valve is disposed along with the second control unit in a primary control circuit, for example a coolant circuit, of an internal combustion engine. The second control unit, together with the control valve, constitutes a subordinate control circuit. Consequently, the control valve has its own control intelligence and in the event of a malfunction, can take over the important functions even without the primary, first control unit. According to one embodiment of the invention, the first or second control unit thus has a malfunction detection which in the event of a malfunction, automatically switches to emergency operation. Normally, only a limited data exchange with the first control unit is required so that there can be savings with regard to signal lines. The connection between the second control unit and the primary, first control unit is chiefly used to preset the microcontroller of the second control unit with the set-point value for the adjustment of the throttle body.

BRIEF DESCRIPTION OF THE DRAWINGS

Other advantages ensue from the following description of the drawings. Exemplary embodiments of the invention are depicted in the drawings. The drawings, the description, and the claims contain numerous features in combination. The specialist will also suitably consider the features individually and will arrange them to form other suitable combinations.

DETAILED DESCRIPTION OF THE PREFERRED EMBODIMENTS

Figure 1:
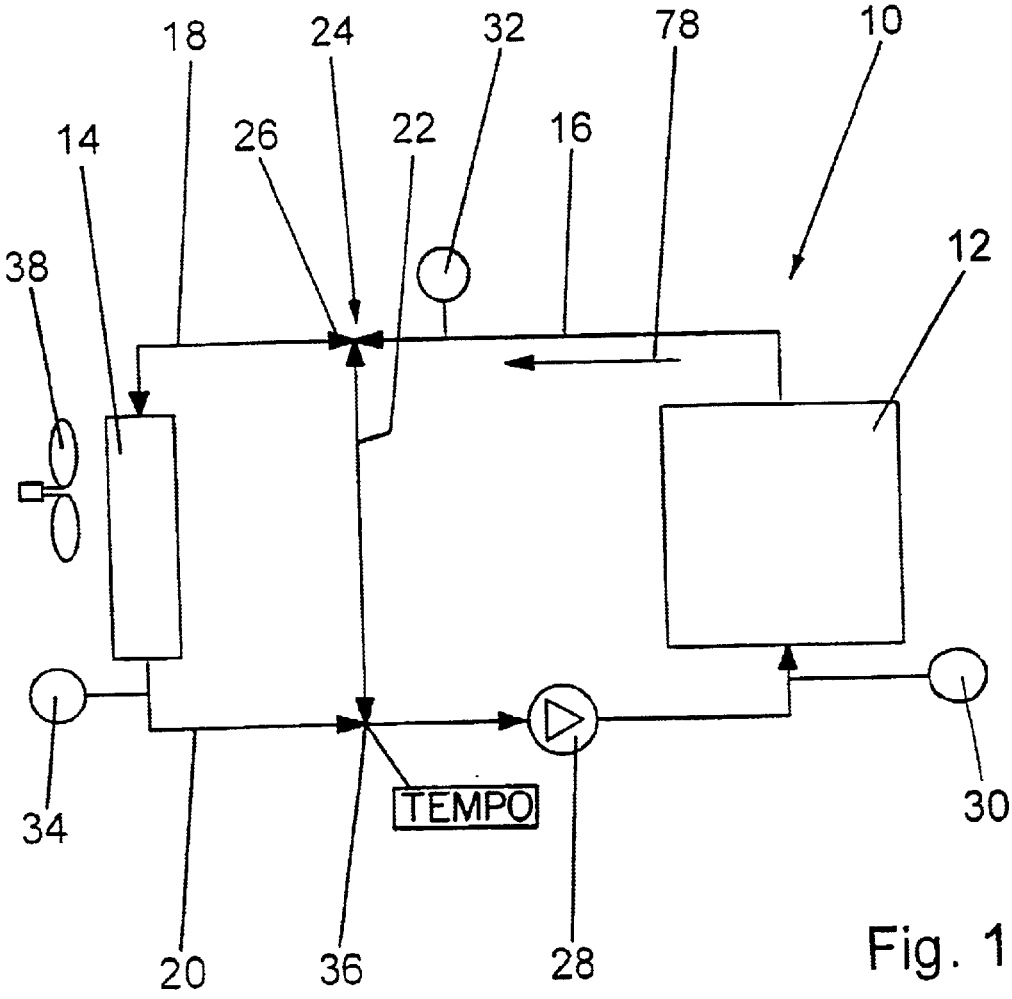
FIG. 1 is a schematic representation of a coolant circuit of an internal combustion engine.

In the exemplary embodiment shown, an internal combustion engine 12 represents a heat source while a radiator 14 constitutes a heat sink. The engine 12 is connected via a coolant line 16 to a radiator circuit 18 of the radiator 14. An electrically driven coolant pump 28 feeds the coolant from a radiator return 20 back to the engine 12. The coolant circuit thus formed is provided with the reference numeral 10. An arrow 78 indicates the direction of the coolant flow. A fan 38 acts on the radiator 14 with cooling air, causing it to dissipate heat from the coolant to the surroundings.

The radiator 14 can be bypassed by means of a bypass line 22. The bypass line 22 branches at a junction 24 from the coolant line 16 and at its outlet 36, is connected to the radiator return 20. The junction 24 is provided with a control valve 26, which distributes the total coolant flow in the coolant line 16 to the radiator inlet 18 and the bypass line 22 in the manner according to the invention.

To this end, a temperature sensor 32 is situated at the outlet of the engine 12 and a temperature sensor 34 is situated at the outlet of the radiator 14. Optionally, an additional temperature sensor 30 is provided at the inlet of the engine 12. The temperature sensor 30 detects a coolant temperature, which approximately corresponds to the coolant temperature at the outlet 36 of the bypass line 22, provided that the bypass line 22 is short and the distance of the junction 24 from the temperature sensor 30 is not too great. If these prerequisites are not met, it is useful to provide the outlet 36 of the bypass line 22.

With the aid of the temperature values determined and a characteristic curve or characteristic field for the control valve 26, a first control unit 40 determines a set-point value 50 for the position of the throttle body 58 of the control valve 26, where the position of the throttle body 58 determines the ratio x of the radiator volume flow to the total coolant flow. The desired ratio is $$X_{set\text{-}point}=(T_{MA}-T_{Me\ set\text{-}point})/(T_{MA}-T_{KA})$$

where $T_{MA}$ is the temperature at the outlet 36 of the bypass line 22, at the outlet of the engine 12, at the control valve 26, $T_{Me\ set\text{-}point}$ is the set-point temperature at the inlet of the engine 12, and $T_{KA}$ is the temperature at the outlet of the radiator 14.

The set-point value 50 for the position of the control valve 26 is determined based on the ratio $X_{set\text{-}point}$ in conjunction with a characteristic curve or characteristic field for the thermostat valve 26.

Figure 2:
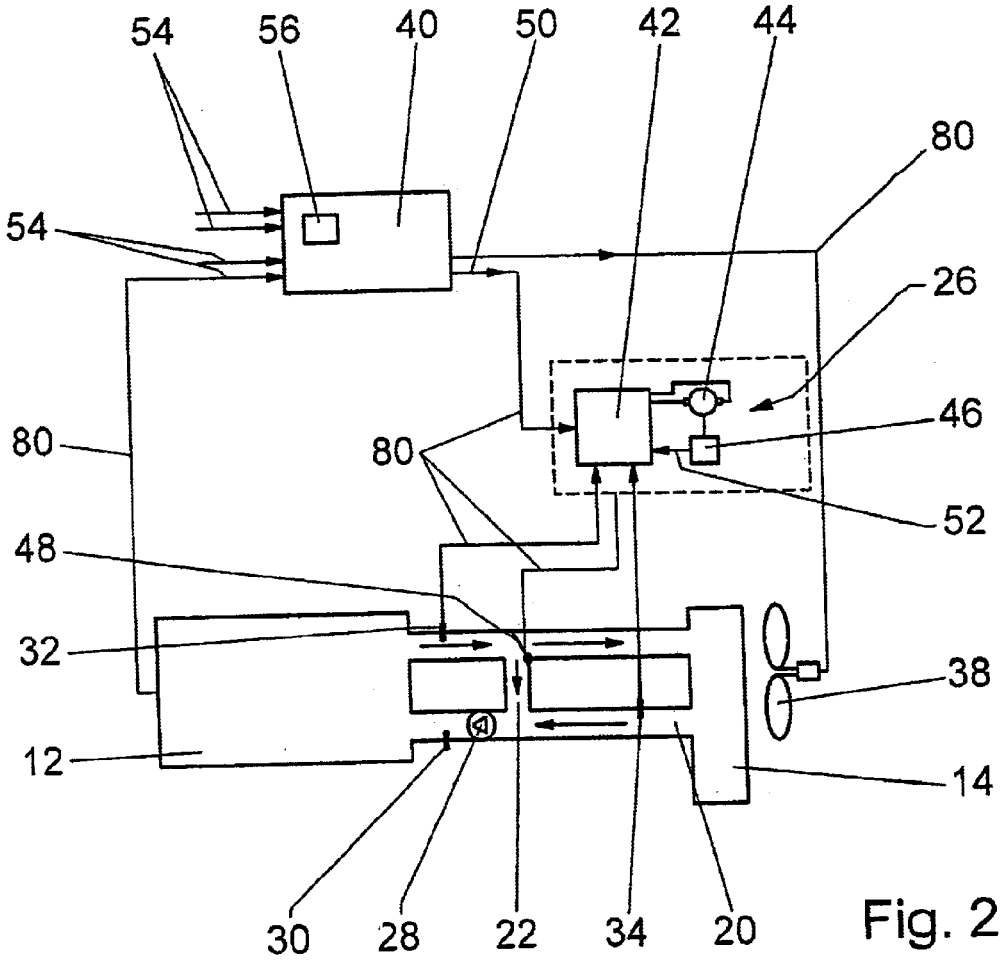
FIG. 2 shows a variant of FIG. 1.

Intrinsically known electronic control units, which are not shown in detail in FIG. 1, are used to determine the set-point value 50. The embodiment according to FIG. 2 has a first control unit 40 and a second control unit 42. These control units 40, 42 are connected to each other and to the sensors 30, 32, 34 via signal lines 80. The second control unit 42, together with a drive mechanism 44, a position measuring device 46, and an actuator 48, is integrated into the control valve 26 so that this control valve 26 can independently determine the position of the throttle body 58 in the manner according to the invention. The first control unit 40 permits a primary control and regulation in that by means of a set-point value generator 56, it predetermines the set-point value 50 for the second control unit 42 as a function of numerous input signals 54, which among other things include the temperature signals of the temperature sensors 30, 32, 34. Consequently, the control of the second control unit 42 can be subordinate to a regulation as a function of other relevant parameters, e.g. as a function of the temperature of the coolant at the inlet of the engine 12. Suitably, the control units 40, 42 can be programmed for a number of different characteristic curves of the control valve 26.

Figure 3:
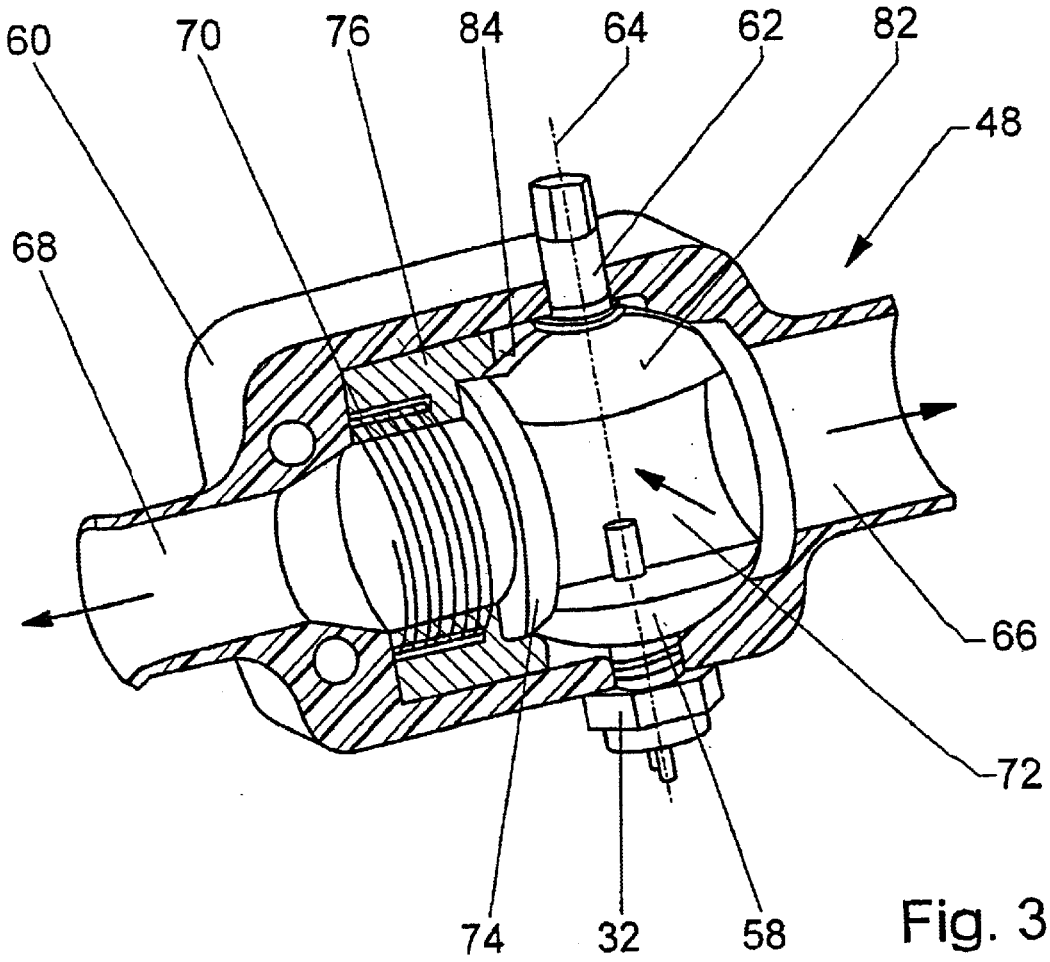
FIG. 3 is a perspective partial section through a control valve.

The control valve 26 according to FIG. 3 is embodied as a three-way valve and is essentially comprised of a valve body 60 and a throttle body 58, which suitably has a spherical surface. However, other surface shapes are also conceivable, for example cylindrical or conical ones.

The throttle body 58 is suitably embodied as an injection molded part made of a thermoplastic plastic. Preferably, a drive shaft 62 is injection molded in one work cycle and an inner distributor conduit 72 and a bore for containing the temperature sensor 32 are formed by means of insert parts which are inserted into the mold before the injection molding process. The temperature sensor 32, which is situated diam trically opposit from the drive shaft 62 and protrudes into the distributor conduit 72, is integrated in a simple manner into the control valve 26 and detects the coolant temperature immediately in this vicinity, i.e. in the vicinity of the outlet of the engine 12, when the control valve 26 is flange-mounted by means of screws to a coolant outlet opening on the engine 12.

The distributor conduit 72 extends lateral to a rotation axis 64 of the throttle body 58 and is open at a circumference surface 82 essentially parallel to the rotation axis 64, while it is closed at the opposite circumference surface 84.

The valve body 60 constitutes the outer part of the control valve 26 and has a connection at the open end toward the circumference surface 82 for the coolant line 16 coming from the engine 12, a connection 68 for the radiator inlet 18, and a connection 66 for the bypass line 22. The connections 66, 68 and the connection to the bypass line 22 are disposed in a plane perpendicular to the rotation axis 64.

In the vicinity of the connections 66 and 68, which are situated diametrically opposite each other, but which can also be situated at a smaller angle in relation to each other, the valve body 60 has separate sealing rings 74 oriented toward the throttle body 58, which are preferably comprised of tetrafluoroethylene and simultaneously serve as supports for the throttle body 58. One sealing ring 74 is secured in the vicinity of the connection 68 by means of a sleeve 76, whose end surface rests against the sealing ring 74. The sleeve 76 is pressed against the sealing ring 74 by a helical spring 70. In this manner, the wear on the sealing rings 74 is compensated for and a sufficient seal is assured for the entire service life of the product.

| Reference Numerals | |
|---|---|
| 10 | coolant circuit |
| 12 | heat source |
| 14 | radiator |
| 16 | coolant line |
| 18 | radiator inlet |
| 20 | radiator return |
| 22 | bypass line |
| 24 | junction |
| 26 | control valve |
| 28 | coolant pump |
| 30 | temperature sensor |
| 32 | temperature sensor |
| 34 | temperature sensor |
| 36 | outlet |
| 38 | fan |
| 40 | first control unit |
| 42 | second control unit |
| 44 | drive mechanism |
| 46 | position measuring device |
| 48 | actuator |
| 50 | set-point value |
| 52 | actual value |
| 54 | input signal |
| 56 | set-point value generator |
| 58 | throttle body |
| 60 | valve body |
| 62 | drive shaft |
| 64 | rotation axis |
| 66 | connection |
| 68 | connection |
| 70 | helical spring |
| 72 | distributor conduit |
| 74 | sealing ring |
| 76 | sleeve |
| 78 | arrow |
| 80 | signal line |
| 82 | circumference surface |
| 84 | circumference surface |

What is claimed is:

1. A coolant circuit (10), comprising:

at least one heat source (12), a radiator (14), and a bypass line (22), which connects a radiator inlet (18) to a radiator return (20) and whose junction (24) has a control valve (26) disposed in it, whose throttle body (58) is controlled by a control means as a function of operating parameters and environmental parameters by means of at least one control unit (40, 42) and divides the coolant flow between the radiator inlet (18) and the bypass line (22), wherein according to a characteristic curve of the control valve (26), the control unit (40, 42) determines a set-point value (50) for the position of the throttle body (58), which sets a ratio of the radiator volume flow to the total coolant flow at the control valve (26) according to the following equation:

$$X_{set\text{-}point}=(T_{MA}-T_{Me\ set\text{-}point})/(T_{MA}-T_{KA})$$

where $T_{MA}$ is the temperature of the outlet (36) of the bypass line (22), at the outlet of the at least one heat source (12), or at the control valve (26), $T_{Me\ set\text{-}point}$ is the set-point temperature at the inlet of the at least one heat source (12), and $T_{KA}$ is the temperature at the outlet of the radiator (14), and where the ratio of the radiator volume flow to the total coolant flow is set equal to zero when there is a negative value and is limited to one when there is a value greater than one.

2. The coolant circuit (10) according to claim 1, wherein the throttle body (58) is a valve tap, has at least one distributor conduit (72) passing through it, and can be moved around a rotation axis (64) by a drive mechanism (44).

3. The coolant circuit (10) according to claim 2, wherein the throttle body (58) has a spherical surface and an internal distributor conduit (72), which extends lateral to a rotation axis (64) and is open at one circumference surface (82) essentially parallel to the rotation axis (64), while the opposite circumference surface (84) is closed.

4. The coolant circuit (10) according to claim 2, wherein the throttle body (58) is supported in a valve body (60) that has a temperature sensor (32), which protrudes into the distributor conduit (72) in a vicinity of the rotation axis (64).

5. The coolant circuit (10) according to claim 1, wherein a first electronic control unit (40) generates the set-point value (50) for the position of the throttle body (58) and a second electronic control unit (42), which is integrated into the control valve (26), processes this set-point value, along with a detected actual value (52) of the position of the throttle body (58) to produce a correcting variable for the position of the throttle body (58).

6. The coolant circuit (10) according to claim 5, wherein at least one of the control units (40, 42) is programmable for different valve characteristic curves.

7. The coolant circuit (10) according to claim 1, wherein the control is subordinate to a regulation as a function of a temperature at the inlet of the heat source (12).

8. The coolant circuit (10) according to claim 7, wherein the correcting variable of the regulating device is limited to a part of the adjustment path of the throttle body (58).

9. The coolant circuit (10) according to claim 7, wherein the regulating device is a gain-scheduling P regulator.

* * * * *